US007951268B2

(12) United States Patent
Schmid et al.

(10) Patent No.: US 7,951,268 B2
(45) Date of Patent: May 31, 2011

(54) MACHINE TO PRODUCE A FIBROUS WEB

(75) Inventors: Christian Schmid, Tettnang (DE); Andreas Meschenmoser, Horgenzell (DE); Werner Leitenberger, Schlier (DE)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 254 days.

(21) Appl. No.: 12/180,197

(22) Filed: Jul. 25, 2008

(65) Prior Publication Data

US 2009/0008053 A1 Jan. 8, 2009

Related U.S. Application Data

(63) Continuation of application No. PCT/EP2006/069991, filed on Dec. 20, 2006.

(30) Foreign Application Priority Data

Jan. 25, 2006 (DE) ..... 10 2006 003 787
Jan. 26, 2006 (DE) ..... 10 2006 003 917

(51) Int. Cl.
*D21F 3/00* (2006.01)
*D21F 5/00* (2006.01)

(52) U.S. Cl. ..... 162/280; 162/358.2; 162/358.3; 162/361; 162/363; 162/901

(58) Field of Classification Search ..... 162/272, 162/275–281, 358.1–358.5, 359.1, 360.2, 162/361, 363, 347, 900–902
See application file for complete search history.

(56) References Cited

U.S. PATENT DOCUMENTS

| | | | | |
|---|---|---|---|---|
| 2,544,572 | A * | 3/1951 | Vickery | 162/279 |
| 3,215,592 | A * | 11/1965 | Justus et al. | 162/252 |
| 3,313,679 | A * | 4/1967 | Hintermaier et al. | 162/199 |
| 3,600,273 | A * | 8/1971 | McCarrick et al. | 162/273 |
| 3,630,837 | A | 12/1971 | Freuler | |
| 3,630,838 | A * | 12/1971 | Bryand et al. | 162/371 |
| 4,551,199 | A | 11/1985 | Weldon | |
| 4,689,119 | A * | 8/1987 | Weldon | 162/281 |
| 4,698,134 | A * | 10/1987 | Green et al. | 162/199 |
| 4,834,838 | A * | 5/1989 | Klowak | 162/109 |
| 4,849,054 | A | 7/1989 | Klowak | |
| 5,314,584 | A | 5/1994 | Grinnell et al. | |
| 6,000,143 | A | 12/1999 | Oechsle | |
| 7,399,378 | B2 * | 7/2008 | Edwards et al. | 162/111 |

(Continued)

FOREIGN PATENT DOCUMENTS

DE 1203111 6/1960

(Continued)

*Primary Examiner* — José A Fortuna
(74) *Attorney, Agent, or Firm* — Laura L. Bozek

(57) ABSTRACT

An apparatus for the production of a fibrous web, especially a tissue or hygienic web, the fibrous web runs through a press nip which is formed by a press unit and a backing roll and the web is subsequently run through a creping nip which is formed by the backing roll and a creping roll around which a textured belt is looped. Moreover, the creping roll is equipped with its own drive. The creping roll can be pressed against the backing roll through a pivoted lever whose pivoting axis which is parallel with the axes of the creping roll and is positioned such that the connecting line between the pivoting axis and the creping roll axis forms an angle of approximately 90° with the connecting line between the creping roll axis and the backing roll axis, when viewed in a vertical plane relative to these axes.

6 Claims, 1 Drawing Sheet

U.S. PATENT DOCUMENTS

| | | | | |
|---|---|---|---|---|
| 7,585,388 | B2 * | 9/2009 | Yeh et al. | 162/109 |
| 7,608,164 | B2 * | 10/2009 | Chou et al. | 162/112 |
| 2004/0238135 | A1 * | 12/2004 | Edwards et al. | 162/111 |
| 2005/0217814 | A1 * | 10/2005 | Super et al. | 162/111 |
| 2008/0029235 | A1 * | 2/2008 | Edwards et al. | 162/111 |
| 2008/0105394 | A1 * | 5/2008 | Kokko | 162/111 |
| 2008/0236772 | A1 * | 10/2008 | Edwards et al. | 162/112 |
| 2008/0245492 | A1 * | 10/2008 | Edwards et al. | 162/111 |
| 2008/0264589 | A1 * | 10/2008 | Chou et al. | 162/112 |
| 2009/0008053 | A1 * | 1/2009 | Schmid et al. | 162/280 |
| 2010/0006249 | A1 * | 1/2010 | Kokko et al. | 162/111 |

FOREIGN PATENT DOCUMENTS

| | | | |
|---|---|---|---|
| DE | 102006003787 | A1 * | 7/2007 |
| DE | 102006003917 | A1 * | 8/2007 |
| EP | 1437516 | A2 | 7/2004 |
| WO | 2004033793 | A3 | 4/2004 |
| WO | WO 2007085335 | A1 * | 8/2007 |

* cited by examiner

MACHINE TO PRODUCE A FIBROUS WEB

This is a continuation of PCT application No. PCT/EP2006/069991, entitled "MACHINE FOR THE PRODUCTION OF A FIBER WEB", filed Dec. 20, 2006, which is incorporated herein by reference.

BACKGROUND OF THE INVENTION

1. Field of the Invention

The present invention relates to an apparatus for the production of a fibrous web, in particular a tissue or hygienic web.

2. Description of the Related Art

Machines of this type are known, and are incorporated hereby from U.S. Pat. Nos. 5,314,584, and 4,849,054 and International publication WO 2004/033793 A3.

A problem with the machine of the type referred to therein is in the necessary speed differential between the creping roll and the backing roll. This speed differential may vary with each different paper type, especially relative to the desired creping factor, resulting in a high load upon the textured belt serving as the creping belt.

In general, the creping roll may be pressed against the backing roll by way of a pivoted lever. This results in an additional problem due to frictional force, which could unintentionally influence the line force in the creping nip.

What is needed in the art is an improved apparatus for the production of a fibrous web, especially a tissue or hygienic web, in which the aforementioned problems have been eliminated.

SUMMARY OF THE INVENTION

The present invention is designed such that the technology that includes the creping process by way of a textured belt may be integrated into a stable process and a good paper quality achieved, while reducing the operating and investment costs and increasing runability.

One embodiment of the apparatus of the present invention addresses a problem with the existing art by providing a creping roll equipped with its own drive. By utilizing such a directly driven creping roll the load on the textured belt is reduced to a minimum and the stability of the belt run is optimized. Preferably, the backing roll is also equipped with its own drive.

After the creping nip the fibrous web is delivered, together with the structured belt to a dryer cylinder onto which the fibrous web is transferred from the textured belt. The web transfer may occur in the area of a transfer nip, which is formed between a press roller, around which a textured, preferably permeable belt is looped, and the dryer cylinder. The press roller in this instance is preferably in the embodiment of a solid jacket press roller with a rubberized cover, for example a Gi-cover.

Alternatively, the press roller may also be in the embodiment of a shoe press roller or a suction press roller. According to a preferred practical design variation of the inventive machine, the press roller is also equipped with its own drive. Advantageously the textured belt is guided by guide rollers. In order to achieve an as uniform as possible tensile stress over the entire length of the textured belt it is advantageous if at least one of the guide rollers is equipped with its own drive.

At least one suction tube for conditioning purposes may be allocated to the revolving textured belt. This would be provided following the transfer nip and prior to the creping nip, when viewed in the direction of web travel. Suction tubes of this type, however, cause a braking force upon the wire. According to one embodiment of the present invention, at least one guide roll, which is equipped with its own drive, is therefore provided after the suction tube, when viewed in direction of web travel. At the same time, the guide roller, which is equipped with its own drive, is located before the creping nip, when viewed in the direction of web travel. However, at least one such guide roller, which is equipped with its own drive, can also be provided as an alternative or additionally after the creping nip. Here the wrap angle of a respective guide roller with its own drive is as great as possible.

The textured belt is in one embodiment of the present invention a textured wire. According to one embodiment of the inventive machine the textured belt is embodied by a TAD (through-air-drying) wire. The press unit is preferably a press roller. A press roller with a relatively rigid roll shell may be provided.

In accordance with another practical embodiment of the present invention, the press unit is a shoe press unit, preferably a shoe press roll with a relatively flexible roll shell. The dryer cylinder, which receives the fibrous web from the textured belt, is a Yankee-cylinder. In one embodiment of the present invention, the backing roll is embodied by a dryer cylinder. A dryer hood may be allocated to the backing roll. It is also advantageous if the backing roll possesses a smooth surface or is respectively equipped with a smooth cover.

In accordance with an embodiment of the present invention the creping roll can be pressed against the backing roll through a pivoted lever having a pivoting axis, which is parallel with the axes of the creping roll and the mating roll. The pivoting axis is positioned such that the connecting line between the pivoting axis and the creping roll axis forms an angle of approximately 90° with the connecting line between the creping roll axis and the backing roll axis, when viewed in a vertical plane relative to these axes.

The present invention therefore eliminates the possibility that the effects of the speed differential between the creping roll and the backing roll act upon the pressure force with which the creping roll is pressed against the backing roll, for example, during vibrations in the rotational movement of the creping roll, or during the so-called "slip-stick" effects.

The pivoted lever is mounted on a support, which is allocated to the backing roll. At the same time, the pivoting lever may be mounted on a longitudinal support allocated to the backing roll. The pivoting lever may also be mounted directly on the support that is allocated to the backing roll. The loop of the textured belt or TAD-wire may, for example, be run between 15 and 40% slower than the wire- or belt loop in the former and/or the press.

Amongst others, the following advantages are achieved with the apparatus of the present invention:

The wire tension prior to the creping roll is reduced since there is no longer a braking effect occurring prior to the creping roll. Since the drives of the creping roll and the backing roll are frictionally engaged with each other through the creping nip, the vibration tendency of the system is reduced to a minimum. In addition, the influence of the very high wire tension upon the line force between the creping roll and the backing roll is further largely eliminated, especially when a change in the speed differential occurs. The positioning of the pivoting lever, which is allocated to the creping roll, prevents an effect upon the line force caused by the frictional force which occurs in the creping nip. The vibration tendency of the system is reduced to a minimum. In addition, a longer lifespan is achieved for the textured belt or the TAD wire respectively.

The fibrous web which is creped in the creping nip between the textured belt and the backing roll can, for example, be fixed in the textured belt or TAD-wire respectively by way of a suction box or similar device after the creping nip.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
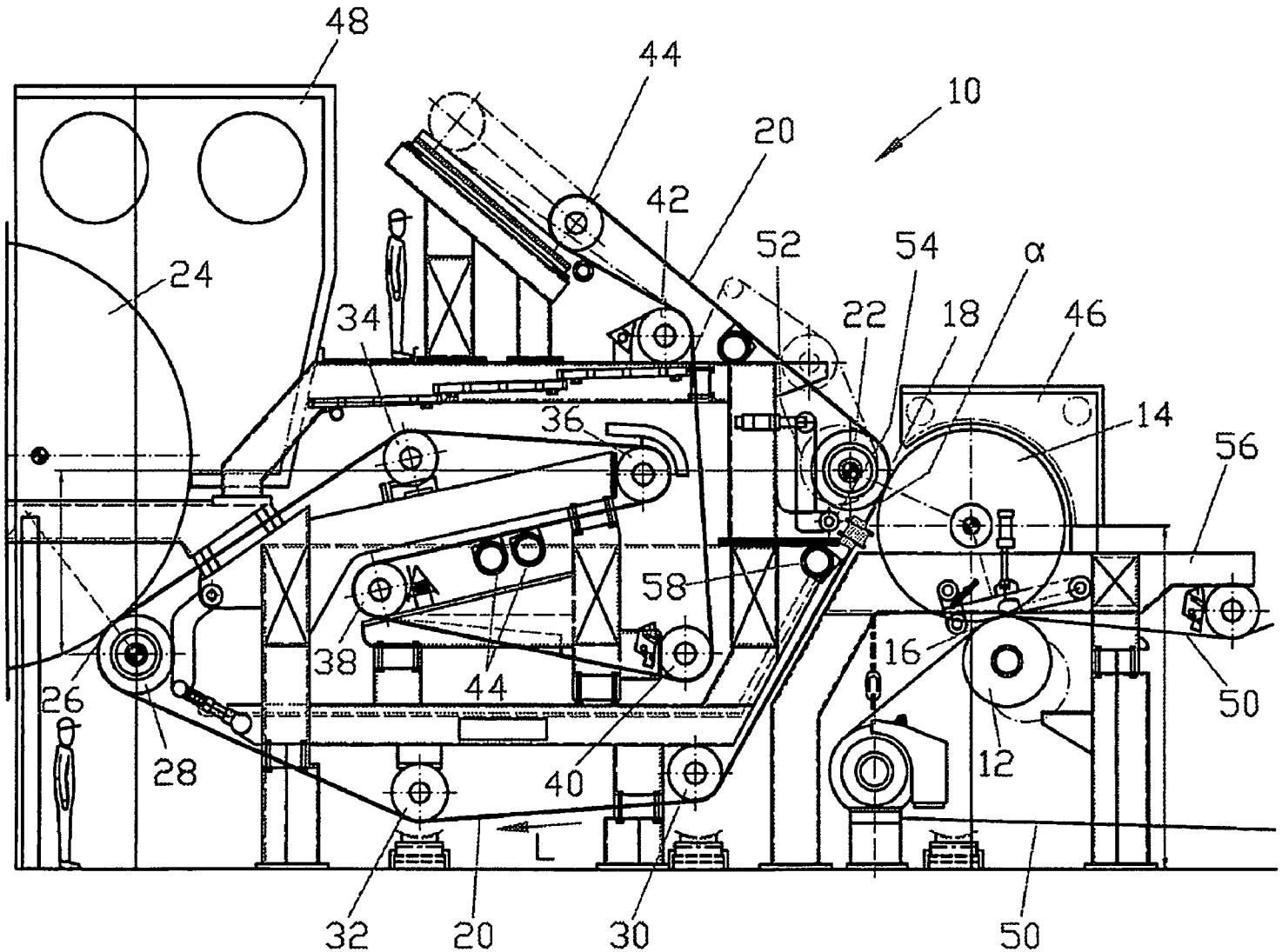
FIG. 1 shows a representation of an embodiment of an apparatus of the present invention for producing a fibrous web, in particular a tissue or hygienic web.

Referring now to the drawings, and more particularly to FIG. 1, there is shown an apparatus 10, also known as a papermaking machine 10, with a fibrous web running through a press nip 16, which is formed between a press unit 12 and a backing roll 14. The fibrous web then runs through a creping nip 18 which is formed between backing roll 14 and a creping roll 22 around which a textured belt 20 is looped. In this example, creping roll 22 is equipped with its own drive, which means that creping roll 22 is driven directly.

In one embodiment of the present invention backing roll 14 is also equipped with its own drive, in other words it is also driven directly, whereby for example, the driving power of creping roll 22 is lower than the driving power of backing roll 14.

After creping nip 18 the fibrous web, together with textured belt 20, which may be a structural belt 2 or a permeable structural belt 2 is carried to a dryer cylinder 24, onto which the fibrous web is transferred from textured belt 20. The web transfer occurs in the area of transfer nip 26, which is formed between a suction press roller 28 around which textured, preferably permeable, belt 20 is wrapped and dryer cylinder 24.

As can be seen from the only drawing, in this embodiment press roll 28 is also equipped with its own drive, in other words it is directly driven.

In addition, textured belt 20 is directed by guide rollers 42, some of which are located inside, and some of which are located outside the loop of textured belt 20.

In this embodiment of the present invention one of these guide rollers, for example guide roller 40 which is located outside the belt loop, is also equipped with its own drive, that is, it is directly driven.

At least one, suction tube 44, which serves a conditioning function, is allocated to revolving textured belt 20. Here suction tubes 44 are located after transfer nip 26 and prior to creping nip 18, when viewed in direction of web travel L.

In this embodiment of the present invention guide roller 40, which is equipped with its own drive, is located after two suction tubes 44 and before creping roll 22, when viewed in direction of web travel L. Since suction tubes 44 perform a braking effect, the additional drive of guide roller 40 ensures that textured belt 20 remains tight. In other words it ensures that overall the belt tension is maintained.

Alternatively or in addition to directly driven guide roller 40, which is located before creping roll 22, at least one guide roller located after creping roll 22 can be equipped with its own drive, in other words, can be directly driven. Here it is advantageous if the angle of wrap respective to a driven guide roller is as great as possible. In principle this applies also to press roll 28, which is also equipped with its own drive.

In this embodiment of the present invention structured belt 20 is embodied by a structured wire, preferably a TAD-wire.

Press unit 12 is, for example, a shoe press unit. In this embodiment it is a shoe press roller with a relatively flexible roll shell. In principle, a press roller having a relatively rigid roll shell and a suitable roll cover is also conceivable.

Dryer cylinder 24, which accepts the fibrous web from textured belt 20, can be a so-called Yankee-cylinder.

Backing roll 14 can be embodied by a dryer cylinder. As can be seen from the only drawing, a dryer hood 46 and 48 are respectively allocated to backing roll 14 and dryer cylinder 24. Backing roll 14 advantageously possesses a smooth surface. Backing roll 14 can, for example, be equipped with a smooth cover.

The fibrous web is carried together with a revolving belt 50, for example a felt belt or similar belt into press nip 16. Following press nip 16 the fibrous web is separated again from revolving belt 50 and is received by backing roll 14. Coming from press nip 16 the fibrous web runs directly on backing roll 14 to creping nip 18 where it is received by textured belt 20, in this case the TAD-wire. The fibrous web is then transferred in transfer nip 16 from textured belt 20 to dryer cylinder 24.

Creping roll 22 can be pressed against backing roll 14 by way of a pivoted lever 52. For this purpose the pivoted axis 54 of pivoted lever 52, which is parallel to the axes of creping roll 22 and backing roll 14, is arranged so that the connecting line between pivoted axis 54 and the creping roll axis forms an angle $\alpha$ of approximately 90° with the connecting line between the creping roll axis and the backing roll axis when viewed in a vertical plane relative to these axes. As can be seen, in this embodiment of the present invention, pivoted axis 54 is located at the free end of an essentially horizontally positioned shorter side of the L-shaped pivoted lever 52 whose longer side is generally aligned upwards and at whose free end pivoted lever 52 is adjusted accordingly.

Pivoted lever 52 can be mounted on a support 56 which may, for example, be a longitudinal support which is allocated to backing roll 14. Pivoted lever 52 may be mounted directly on longitudinal support 56.

An additional suction tube 58 is provided behind creping roll 22, when viewed in direction of web travel L, through which the fibrous web is fixed in textured belt 20, or the TAD-wire, following creping nip 18.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LISTING

10 Machine
12 Press unit
14 Backing roll
16 Press nip

18 Creping nip
20 Textured belt
22 Creping roll
24 Dryer cylinder
26 Transfer nip
28 Press roller
30 Guide roller
32 Guide roller
34 Guide roller
36 Guide roller
38 Guide roller
40 Guide roller
42 Guide roller
44 Suction roller
46 Dryer hood
48 Dryer hood
50 Revolving belt
52 Pivoted lever
54 Pivoted lever
56 Support
58 Suction tube
L Direction of web travel
α Angle

What is claimed is:

1. A papermaking machine for the production of a fibrous web, the fibrous web being one of a tissue web and a hygienic web, the machine comprising:

a shoe press unit comprising a shoe press roll having a flexible roll shell;

a backing roll engageable with said shoe press unit, said shoe press unit and said backing roll forming a press nip through which a fibrous web may be passed, said backing roll being equipped with a dedicated drive;

a creping roll, pressable against said backing roll and adapted to, said creping roll being equipped with a dedicated drive;

a textured belt wrapped around a portion of said creping roll;

said creping roll and said backing roll forming a creping nip through which said fibrous web may be passed, and brought into engagement with said textured belt;

a pivoted lever rotatable about a pivoted axis, said creping roll being pressable against said backing roll by way of said pivoted lever, said pivoted axis of said pivoted lever being parallel to an axis of said creping roll and an axis of said backing roll, the axes being arranged so that a connecting line between said pivoted axis and said axis of said creping roll forms an angle α of approximately 90° with a connecting line between said axis of said creping roll and the said axis of said backing roll when viewed in a vertical plane relative to these axes;

a drying cylinder, subsequent to said creping nip in a direction of travel of the fibrous web, adapted to receive the fibrous web; and a press roller engageable with said drying cylinder, said press roller and said drying cylinder forming a transfer nip therebetween, the fibrous web being transferred to said drying cylinder proximate to said transfer nip, said press roller being equipped with a dedicated drive.

2. The papermaking machine of claim 1, further comprising at least one suction tube allocated for conditioning of said textured belt, said at least one suction tube being located after said transfer nip and prior to said creping nip when viewed in a direction of web travel and a plurality of guide rollers, said textured belt being directed by said guide rollers, wherein at least one of said guide rollers which is located after said suction tube and before said creping nip when viewed in the direction of web travel is equipped with a dedicated drive.

3. The papermaking machine of claim 2, further comprising a support associated with said backing roll, said pivoted lever being mounted on said support.

4. The papermaking machine of claim 3, wherein said support is a longitudinal support.

5. The papermaking machine of claim 4, wherein said pivoted lever is mounted directly on said longitudinal support.

6. The machine of claim 5, wherein said backing roll has a smooth surface and is equipped with a smooth cover.

* * * * *